US007117575B2

(12) United States Patent
Satou et al.

(10) Patent No.: US 7,117,575 B2
(45) Date of Patent: Oct. 10, 2006

(54) METHOD OF MANUFACTURING A LINK PLATE

(75) Inventors: Toshifumi Satou, Osaka (JP); Masatoshi Chadou, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 233 days.

(21) Appl. No.: 10/813,256

(22) Filed: Mar. 30, 2004

(65) Prior Publication Data

US 2004/0261240 A1 Dec. 30, 2004

(30) Foreign Application Priority Data

Jun. 30, 2003 (JP) ..... 2003-187275

(51) Int. Cl.

| | |
|---|---|
| ***B23P 17/00*** | (2006.01) |
| ***B23P 23/00*** | (2006.01) |
| ***B21D 31/00*** | (2006.01) |
| ***F16G 13/06*** | (2006.01) |

(52) U.S. Cl. ..... 29/412; 29/417; 29/557; 29/564; 72/372; 72/373; 59/4; 59/84

(58) Field of Classification Search ..... 29/412, 29/417, 557, 558, 564; 72/338, 334, 372, 72/373, 464; 76/29, 30, 80.5, 112; 59/4, 59/84

See application file for complete search history.

(56) References Cited

U.S. PATENT DOCUMENTS 3,370,416 A * 2/1968 Edgerton ..... 59/5
4,285,754 A * 8/1981 DiMatteo ..... 156/264
4,360,959 A * 11/1982 Johannesen ..... 29/417
7,021,176 B1 * 4/2006 Sato et al. ..... 76/29

FOREIGN PATENT DOCUMENTS

| | | | |
|---|---|---|---|
| DE | 4303004 A1 * | 8/1994 | |
| JP | 57171528 A * | 10/1982 | |
| JP | 2002-028749 | 1/2002 | |

OTHER PUBLICATIONS

U.S. Appl. No. 10/818,149, Link Plate for Silent Chain and Method of Manufacturing Same, Inventors Name, Toshifumi Sato, filed Apr. 5, 2004.

* cited by examiner

*Primary Examiner*—Jermie E. Cozart
(74) *Attorney, Agent, or Firm*—Howson & Howson

(57) ABSTRACT

In manufacturing a link plate for a roller chain, a band of sheet steel is intermittently forwarded along a path past series of dies, including rough punching dies and shaving dies. The punching dies and corresponding shaving dies are located symmetrically on opposite sides of an intermediate location along the path. The intermediate location coincides with a location at which the lateral deviation of the band reverses. Consequently, the outer peripheral surfaces of the plate and the inner peripheral surfaces of the connecting pin holes, both being formed by rough punching, are brought into very close alignment with the shaving dies.

6 Claims, 6 Drawing Sheets

METHOD OF MANUFACTURING A LINK PLATE

FIELD OF THE INVENTION

This invention relates to roller chains, and more particularly to link plates which are used as components of roller chains, and to a method of manufacturing the same.

BACKGROUND OF THE INVENTION

In a conventional process for manufacturing a link plate for a roller chain, a band of sheet steel is intermittently forwarded to, and punched by, a succession of dies. Edges formed in the punching process, including outer peripheral edges of the partially formed link plates, and inner peripheral edges of connecting pin-receiving holes punched in the link plates, are shaved by means of shaving dies to prevent microscopic cracks from forming.

FIGS. 5 and 6 illustrate the process of producing a link plate 500 by the conventional process. Rough punching and shaving are carried out continuously on a band H of sheet steel. Connecting pin holes 510 are formed first, and then, as shown in the enlargement of region B in FIG. 6, the outer periphery 520 of the link plate is formed. When the roller chain is in use, the outer peripheries 520 of the link plates may contact the surface of a chain guide (not shown).

As shown in FIG. 5, the band H of sheet steel is pulled from a supply roll (not shown) and intermittently forwarded into a link plate punching die assembly D, using pilot holes R as references. The connecting pin holes are punched by rough punching dies d1 and shaved by shaving dies s1. Peripheral parts of the link plates are then formed by rough punching dies d2 and shaved by shaving dies s2. After the link plates 500 are punched by and shaved, the remainder of the band H is recovered by being wound onto a take-up roll (not shown). A very slight bending or strain in the widthwise direction, generated as the band is wound onto the supply roll, causes snaking or slanting of the band as it is forwarded through the die assembly. As shown on an enlarged scale in FIG. 6, because of the snaking of the steel band, the roughly punched areas may become displaced laterally by a distance X when they reach the shaving dies S2.

As a result of the lateral displacement due to snaking of the steel band, especially in the case of a small shaving margin, for example a margin of about 0.1 mm, shaving may not be carried as intended. A portion of the edge of the plate being produced may not be shaved, and this will inevitably cause increased wear in the shoe of a chain guide cooperating with the chain. Moreover, in those parts of the edges of the guide plate where shaving is not performed, microscopic cracks are generated. Chain breakage due to the microscopic cracks could not be prevented, and the required chain strength could not be maintained over a long time. Additionally, whereas ring-shaped chips would ordinarily be produced and discharged in the case of perfect alignment between the shaving die and the roughly punched link plate, the punching displacement X causes the chip to be only partially cut off, and the partially cut off chips are not perfectly discharged. Parts of the chips remain on the link plates 500, as flaws, reducing the quality of the link plates.

A further problem encountered in the conventional method of forming chain plates was that the accuracy of the distance between the inner surfaces 510 of the conventional connecting pin holes and the back surface 520 of the plate could not be maintained. Moreover, bending of the steel band H in the link plate punching die assembly D causes variations in the positions of the plate back surfaces relative to the chain travel line, causing accelerated wear of the shoe of a chain guide.

The general objects of the invention are to solve the above-mentioned problems encountered in the prior art, and to provide a method of manufacturing a link plate for a roller chain, which suppresses displacement of the roughly punched link plate relative to the shaving die, even if bending occurs in the steel band as it is forwarded past the link plate punching die. More uniform punching is attained, and the link plate which is produced exhibits excellent finishing accuracy at the surface which contacts the shoe of a chain guide and at the inner surfaces of the connecting pin holes. In the link plate, an accurate right angle relationship of the punched surfaces and the flat surfaces of the plate is maintained, and the punched surfaces are maintained in accurate, parallel relationship to one another.

SUMMARY OF THE INVENTION

The term "shaving" as used herein refers to a secondary processing step in the fabrication of a link plate, in which a bar-shaped or cylindrical shaving punch having a contour slightly different from that of the rough punch used in the primary punching step is used. In the shaving step, the shaving punch removes a small amount of the contour of the roughly punched portion of the link plate, to remove rough surfaces and shear drops generated in the primary punching step. The shaving process reduces surface roughness and leads to improved surface accuracy.

In the method manufacturing a roller chain link plate in accordance with the invention, a band of sheet steel is intermittently forwarded along a path past a plurality of dies arranged in succession along the direction in which the band of sheet steel is forwarded. At least one of the dies is a rough punching die, and at least one other die is a shaving die. The rough punching die and the shaving die are positioned symmetrically in relation to, and on opposite sides of, an intermediate position along the forwarding direction. The rough punching die punches out a portion of the band to form an edge of a-link plate, and the shaving die shaves the edge formed by the punching die. This edge can be an outer peripheral edge of the link plate, or an inner peripheral edge of a connecting pin hole formed in the link plate. The band of steel sheet deviates laterally relative to a straight line extending along the direction in which the band is forwarded, and the lateral deviation of the band reverses at a fixed location along the path of the band substantially coinciding with the above-mentioned intermediate position. Consequently, in the shaving step, the shaving die is closely aligned with the edge of the link plate formed by the rough punching die.

In one embodiment, the band of steel sheet is punched by a first punching die to form at least one connecting pin hole in a link plate, and by a second punching die to form at least one outer peripheral edge of the same link plate. The connecting pin hole is shaved by a first shaving die, and the outer peripheral edge is shaved by a second shaving die. The first punching die and the first shaving die are symmetrically disposed relative to the intermediate position and on opposite sides thereof respectively, and the second punching die and the second shaving die are also symmetrically disposed relative to the intermediate position and on opposite sides thereof respectively.

In another embodiment, the rough punching die forms outer peripheral edges of a link plate and at least one connecting pin hole in the link plate in a single punching step, and the shaving die shaves the outer peripheral edges and an inner peripheral edge of the at least one connecting pin hole in a single shaving step.

With the punching and shaving steps carried out as described above, the effects of snaking, that is, lateral deviation of the band of steel sheet from a straight line path as it is forwarded past the dies from a supply roll, are greatly reduced. Misalignment of the punched link plates with the shaving dies is reduced to about half the displacement experienced in the case of conventional punching and shaving of roller chain link plates.

The misalignment can be minimized by carrying out punching and shaving respectively at locations close to the intermediate position between the dies. Thus, especially high accuracy can be achieved if the outer periphery and the connecting pin holes are punched simultaneously at a location close to the intermediate location on one side thereof, and shaved simultaneously at a location close to the intermediate location on the other side thereof.

The process in accordance with the invention makes it possible to achieve the desired shear surface ratio reliably, and to avoid microscopic cracks, thereby producing a roller chain capable of maintaining its strength over for a long period of time. The connecting pin holes formed by the process of the invention more accurately fit the connecting pins, and consequently, wear elongation of the chain is reduced. Finally, the accurate punching achieved by the invention ensures a uniform relationship of the positions for the connecting pin holes to the outer peripheral edges of the chain, so that variations in the positions of plate edges with respect to the chain traveling line are reduced.

DETAILED DESCRIPTION OF THE PREFERRED EMBODIMENT

Figure 1:
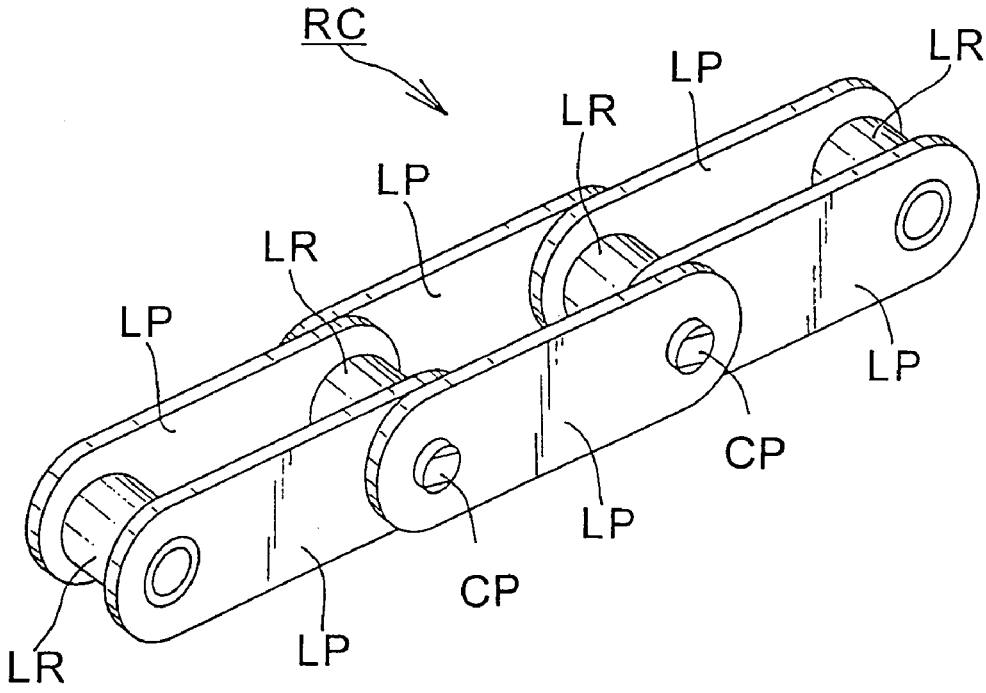
FIG. 1 is a perspective view of a portion of a roller chain the link plates of which are formed by the process in accordance with this invention.

In the roller chain RC, shown in FIG. 1, link plates LP are arranged in overlapping relationship on both sides of the chain and opposed outer link plates of the chain are connected together by connecting pins CP. Rollers LR are provided between the inner link plates, on the connecting pins, or on bushings through which the connecting pins extend.

Figure 2:
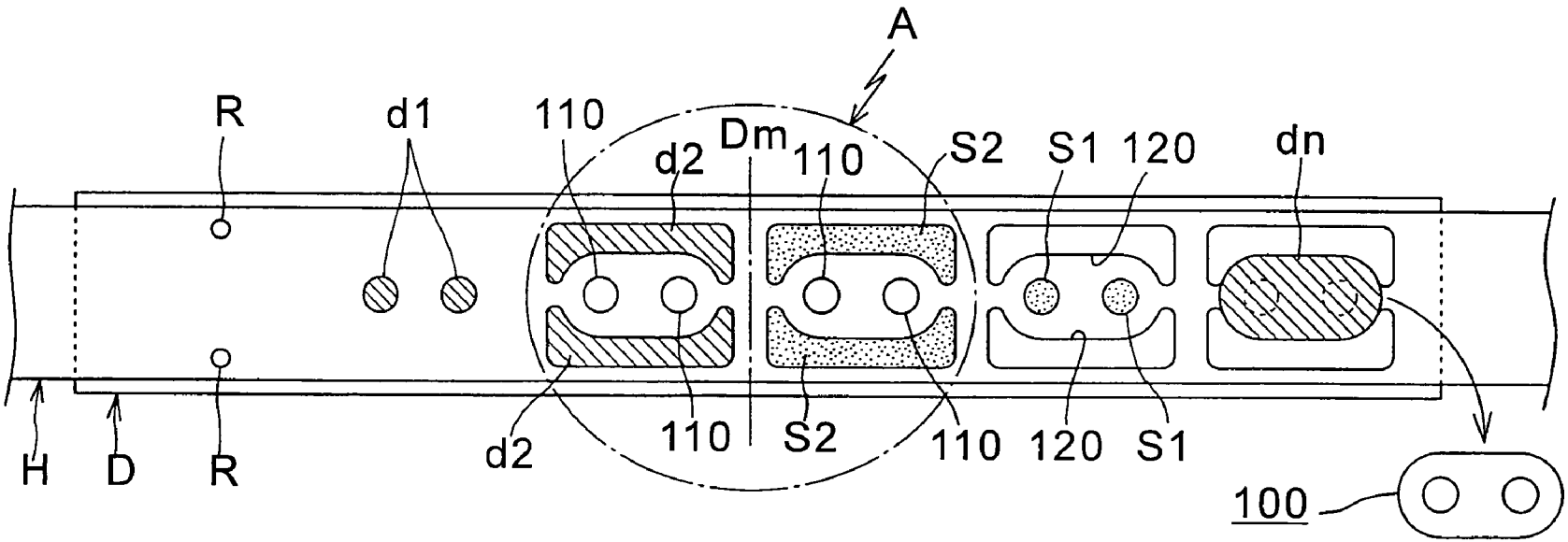
FIG. 2 is a schematic view depicting a method of manufacturing a link plate for a roller chain in accordance with a first embodiment of the invention.

As shown in FIG. 2, a link plate 100 has a pair of connecting pin holes, each having an inner peripheral edge 110. The link plate also has outer peripheral edges 120, portions of which serve as "plate back surfaces" for sliding contact with shoes of chain guides when the chain is in use.

In the production of the link plate, a band H of sheet steel is intermittently forwarded to a die assembly D, which comprises a succession of dies. The dies includes rough punching dies d1, which form the connecting pin holes, and a rough punching die d2, which forms the outer peripheral edges 120 of the plates. After rough punching to form the connecting pin holes and the outer peripheral edges 120, shaving is carried out by dies S2 and S1, which correspond respectively to the rough punching dies d2 and d1. A final die dn punches the link plate 100 from band H.

As will be apparent from FIG. 2, rough punching and shaving of the peripheral edges of the link plate are carried out at locations symmetrically disposed on opposite sides of an intermediate position Dm along the direction of forwarding of the band H. Rough punching and shaving of the connecting pin holes are also carried out respectively at locations symmetrically disposed on opposite sides of intermediate position Dm, the locations of rough punching of the pin holes being respectively farther ahead of, and farther behind, intermediate position Dm than the locations at which the peripheral edges of the link plates are punched and shaved.

The forwarding movement of the band H relative to the dies is controlled by a forwarding control mechanism (not shown), using pilot holes R in the band for reference, so that the band is accurately indexed to the above-described rough punching and shaving stations in symmetrical relationship to intermediate position Dm.

Figure 3:
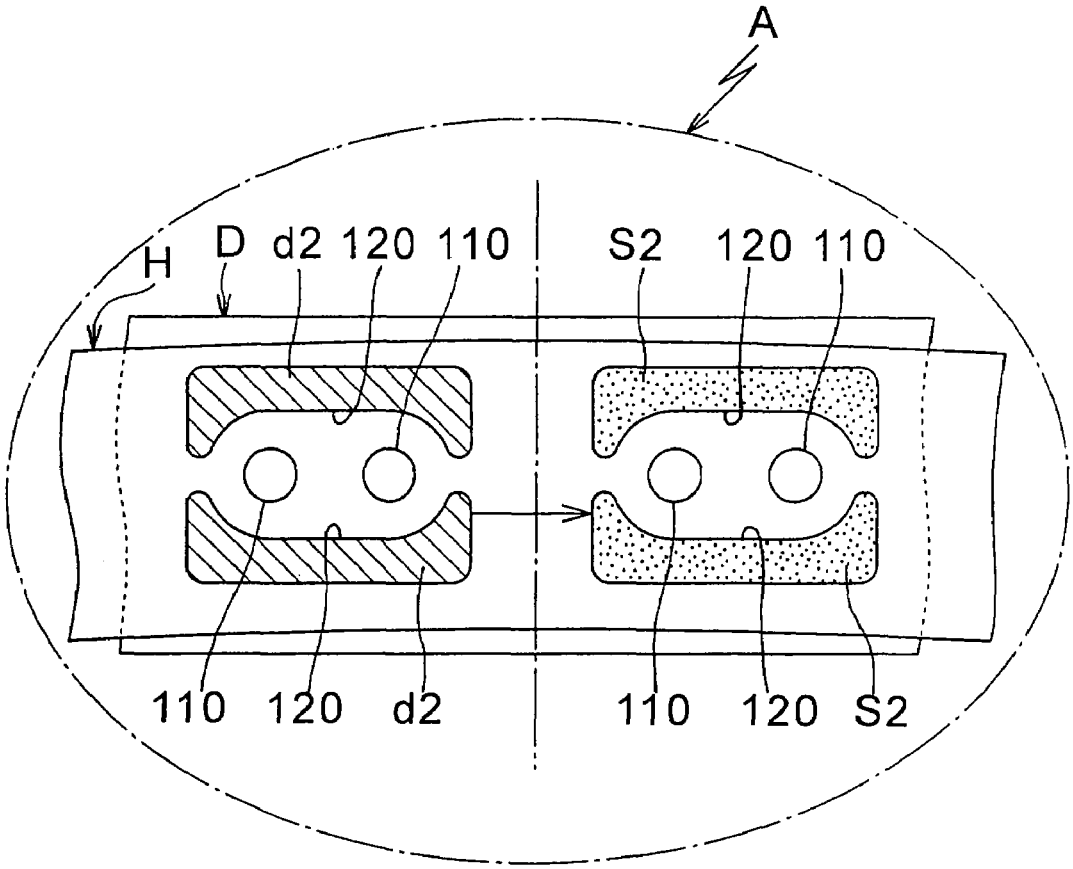
FIG. 3 is an enlarged view of the processing region designated by the letter "A" in FIG. 2.

Snaking of the band H will occur as in the conventional process. However, in this case, the lateral deviation of the band H relative to an imaginary straight line (not shown) extending in the direction of forwarding of the band H is measured. The location at which the lateral deviation reverses, that is, the location at which the lateral displacement reaches a maximum or minimum value, is determined, and the rough punching dies and the shaving dies are disposed on opposite sides of that location. The location of reversal of the lateral deviation is fixed and substantially coincides with the intermediate location Dm, about which the shaving and punching dies d2 and s2 are symmetrical. As shown in FIG. 3, the band H is slightly bent, but the reversal of the lateral deviation of band H occurs at the intermediate location Dm. Accordingly, as the band is moved forward, the areas punched out by the rough punching dies d2 are displaced laterally as they pass through the intermediate location Dm, but return laterally in the opposite direction as they approach the shaving dies S2. As a result, when the punched out areas reach the location of the shaving dies, they are closely aligned with the shaving dies, and the roughly punched link plate is likewise in proper alignment with the shaving dies. The same phenomenon occurs in the case of the connecting pin holes, which are roughly punched by dies d1 at a location ahead of the intermediate location Dm by a given distance, and shaved by dies s1 at a location behind the intermediate location by the same distance. The punched pin holes move laterally by a small distance as they pass through the intermediate location, but return laterally in the opposite direction as they approach the location of the shaving dies s1, so that they become properly aligned with the shaving dies.

Thus, in the process depicted in FIG. 2, even if snaking of the band H occurs as it is forwarded past the succession of dies, the shaving dies are closely aligned with the edges formed by the rough punching dies. The lateral displacement of the band as it proceeds from the rough punching dies to the shaving dies is about one-half or less than the lateral displacement that occurs in the conventional punching and shaving process.

If the rough punching and shaving dies are close to the intermediate position Dm, on opposite sides thereof, maximum suppression of the lateral displacement caused by snaking of the band H, can be achieved.

With the lateral displacement of the punched edges suppressed in accordance with the invention, the shaving margin can be 70%, or more than 70%, of the sheet thickness, and a good shear surface can be formed without generating microscopic cracks, punching flaws, remainder flaws and the like as in the conventional process. Accordingly a desirable shear surface ratio and a low surface roughness can be obtained, so that the wear elongation properties of the chain and chain strength can be maintained over a long interval of time.

The shaving of the outer peripheral edges of the link plates, as well as the shaving of the inner peripheral edges of the connecting pin holes can be carried out to 70% or more of the sheet thickness. As a result, in the operation of the chain, contact surface pressure is uniform and maintained at a low level, so that power loss during power transmission carried out using the chain as a power transmission medium is remarkably decreased.

Figure 4:
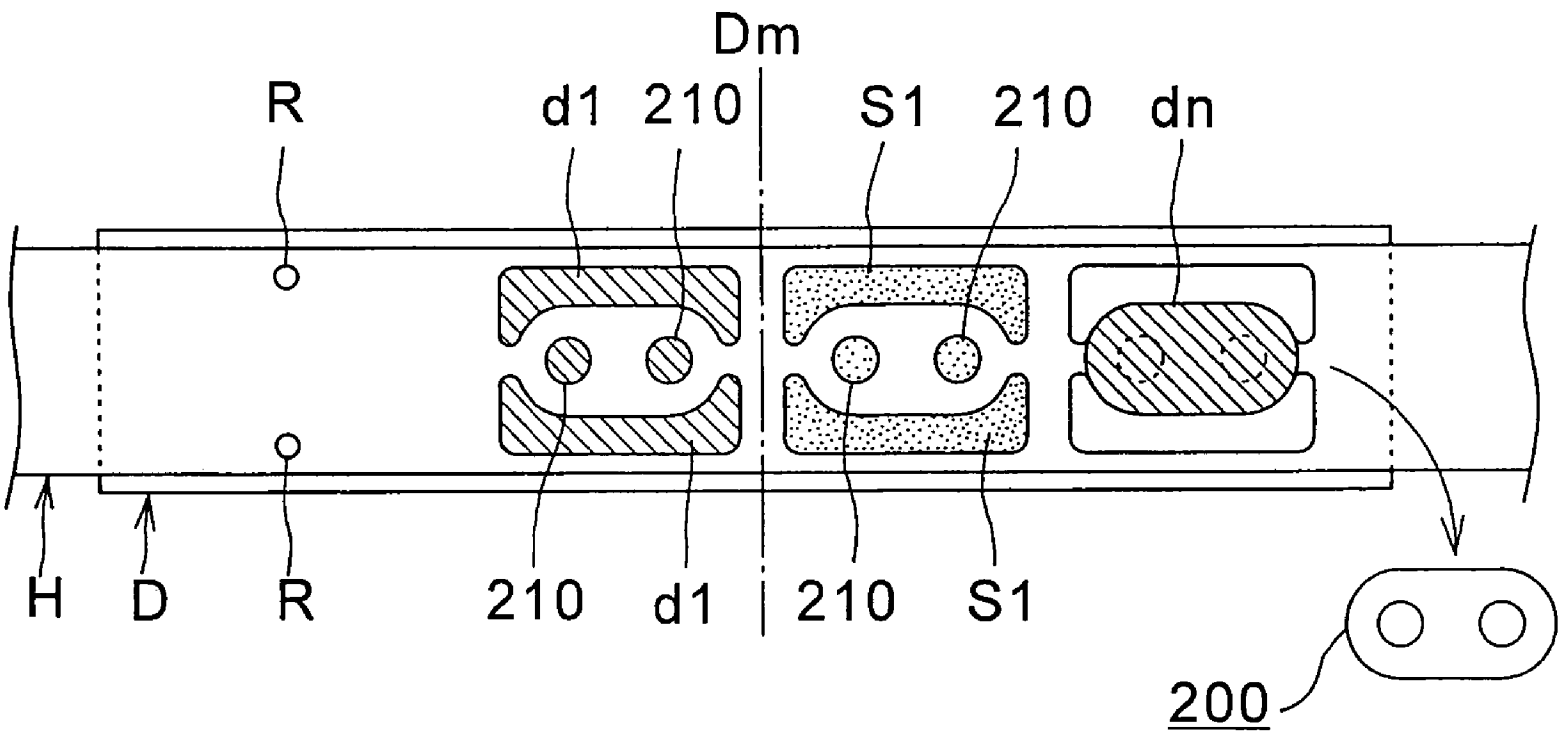
FIG. 4 is a schematic view depicting a method of manufacturing a link plate for a roller chain in accordance with a second embodiment of the invention.
Figure 5:
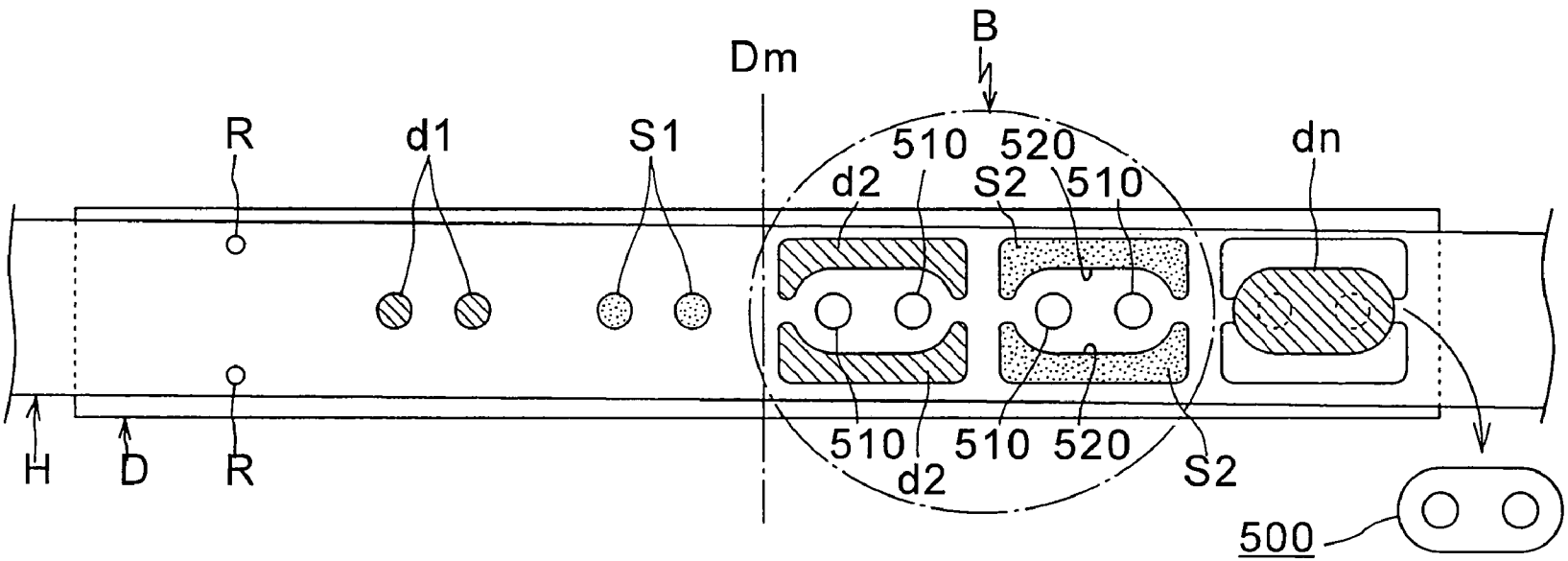
Fig. 5 Prior Art
FIG. 5 is a schematic view depicting a conventional method of manufacturing a link plate for a roller chain.
Figure 6:
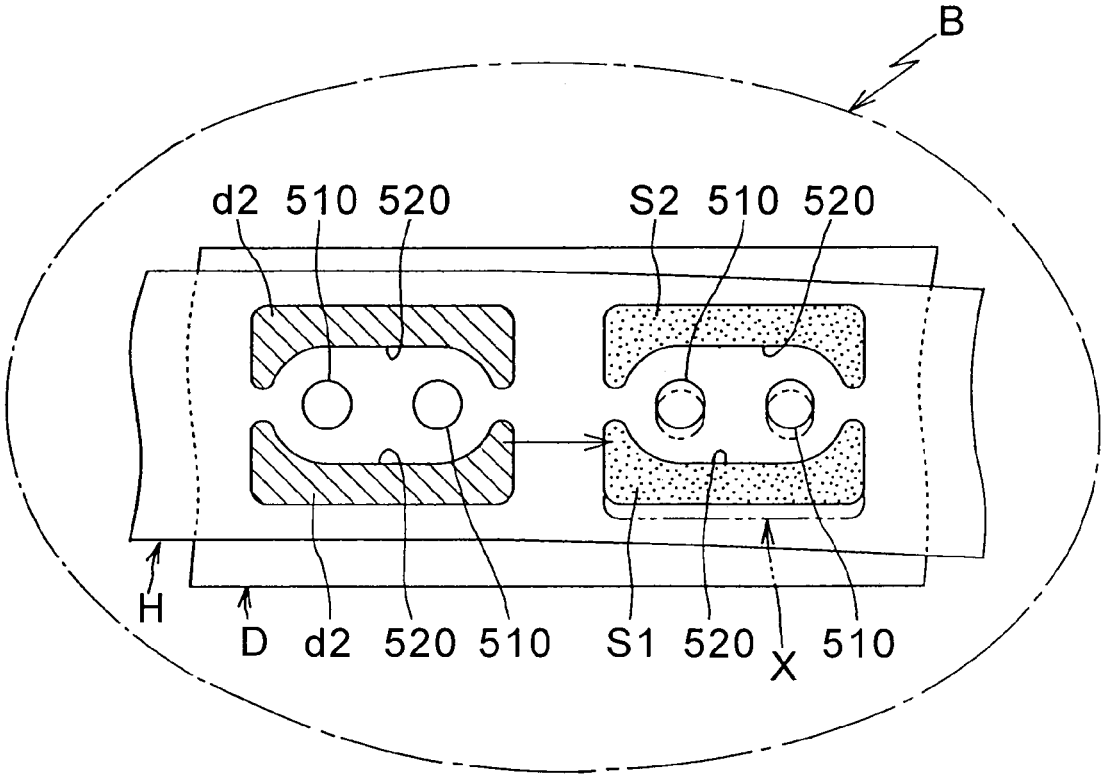
Fig. 6 Prior Art
FIG. 6 is an enlarged view of the processing region designated by the letter "B" in FIG. 5.

In the alternative embodiment depicted in FIG. 4, a link plate 200 has outer peripheral edges, and connecting pin holes with inner peripheral edges 210. In this embodiment, the steel band H is intermittently forwarded to the die assembly D, which simultaneously punches the band, roughly forming both the connecting pin holes 210 and the outer peripheral surfaces of the link plates. Shaving is also carried out simultaneously on both the inner peripheral surfaces of the connecting pin holes and on outer peripheral surfaces of the link plates. Final processing die dn punches the link plate 200 from the steel band H.

As shown in FIG. 4, the rough punching die d1, which forms both the connecting pin holes and the outer peripheral edges of the plates, and the shaving die s1, which shaves both the inner peripheral edges of the connecting pin holes and the outer peripheral edges of the plates, are disposed symmetrically on opposite sides of the intermediate position Dm. Rough punching die d1 performs the functions of both dies d1 and d2 in the embodiment of FIG. 2, and shaving die s1 performs the functions of both shaving dies s1 and s2 in the embodiment of FIG. 2.

As in the first embodiment of the invention, in the second embodiment, the forwarding of the steel band H is controlled by a control mechanism (not shown) so that the locations at which it is respectively punched and shaved are symmetrically disposed on opposite sides of intermediate position Dm.

In the second embodiment, since rough punching and shaving are performed with relative lateral displacement between the band H and the dies suppressed, shaving is performed uniformly on the roughly punched circumferential edges of the link plate, and the shaving margin is preferably 70% or more of the sheet thickness, so that a good shear surface is formed and microscopic cracks, punching flaws, and flaws due to remaining material as in the conventional case, are avoided. Accordingly the desired shear surface ratio and surface roughness are obtained, wear elongation of the chain is controlled, and chain strength can be maintained over a long period of time.

Since shaving corresponding to the rough punching is simultaneously performed on the inner peripheral edges 210 of the connecting pin holes and the outer peripheral edges of the link plate 200, parallelism and accuracy in the distances between these surfaces are uniformly attained. As a result, wear due to one-sided contact between the inner surface of a connecting pin hole and a connecting pin is decreased, and wear elongation of the roller chain is accordingly suppressed.

The invention is of course applicable to the formation of plates of chains utilizing bushings as well as chains lacking bushings.

In summary, with the invention, lateral displacement of the roughly punched link plates relative to the shaving dies, caused by snaking of the steel band, is significantly less (usually by a factor of about one-half) than in the conventional punching and shaving process, and more uniform quality of the link plate can be achieved.

Where rough punching is performed immediately ahead of the intermediate position in the link plate punching die assembly and shaving is performed immediately beyond the intermediate position, lateral displacement, caused by conventional bending of the band of sheet steel is suppressed to the greatest possible extent. Thus highly uniform quality of the link plate can be achieved.

Good finishing accuracy of the inner peripheral surface of a connecting pin hole, which contacts a connecting pin, and of the outer peripheral surface of the link plate, which contacts the shoe surface of a chain guide, can be achieved, and an accurate right angle relationship between the shaved edges and the flat surfaces of the plate, can be attained.

If shaving is simultaneously performed on the inner peripheral edges of the connecting pin holes and the outer peripheral edges of the plate, parallelism of these edges, and the distances between the connecting pin holes, which contact the connecting pins, and the portions of the outer peripheral surfaces of the plate which contact the shoe of a chain guide, can be uniformly and accurately achieved.

Even when the shaving margin is small, with the invention shaving can be performed on a roughly punched inner or outer peripheral portion of a plate uniformly and with high accuracy, so that a good shear surface is formed and microscopic cracks, punching flaws, remainder flaws, and the like, which occur in conventional link plate fabrication, can be avoided. A shear surface ratio and surface roughness can be obtained such that wear elongation can be suppressed, and the chain strength can be maintained, over a long period of time.

Contact surface pressure between the connecting pins and the connecting pin holes is reduced and made uniform, thereby significantly reducing power loss when the chain is used for power transmission.

Finally, by maintaining an accurate relationship between the roughly punched connecting pin holes and the pin hole shaving dies, wear due to one-sided contact between the inner peripheral edges of the connecting pin holes and the connecting pins can also be decreased, so that the wear elongation of the roller chain can also be suppressed.

What is claimed is:

1. A method of manufacturing a link plate for a roller chain, comprising the steps of:

intermittently forwarding a band of sheet steel along a path past a plurality of dies arranged in succession along the direction in which said band of sheet steel is forwarded, wherein at least one of said dies is a rough punching die, and at least one other one of said dies is a shaving die, said rough punching die and said shaving die being positioned symmetrically in relation to, and on opposite sides of, an intermediate position along said direction;

punching said band of steel sheet by said rough punching die, thereby punching out a portion of said band to form an edge of a link plate; and shaving said edge of said link plate by said shaving die;

wherein said band of steel sheet deviates laterally relative to a straight line extending along said direction and past the rough punching and shaving dies, said line being laterally displaced from both said rough punching die and said shaving die in the same direction, and the lateral deviation of said band of sheet steel from said straight line reaches a maximum or minimum at a fixed location along said path substantially coinciding with said intermediate position;

whereby, in said shaving step, said shaving die is closely aligned with said edge of a link plate formed by said rough punching die.

2. A method according to claim 1, in which said rough punching die punches out portions of said band to form outer peripheral edges of a link plate, and said shaving die shaves the outer peripheral edges formed by said rough punching die.

3. A method according to claim 1, in which said edge formed in said punching step is an inner peripheral edge of a connecting pin hole in the link plate.

4. A method according to claim 1, in which said band of steel sheet is punched by a first punching die to form at least one connecting pin hole in a link plate, and by a second punching die to form at least one outer peripheral edge of the same link plate, said at least one connecting pin hole is shaved by a first shaving die, and said at least one outer peripheral edge of the same link plate is shaved by a second shaving die, and in which said first punching die and said first shaving die are symmetrically disposed relative to said intermediate position and on opposite sides thereof respectively, said second punching die and said second shaving die are also symmetrically disposed relative to said intermediate position and on opposite sides thereof respectively.

5. A method according to claim 1, in which said rough punching die forms outer peripheral edges of a link plate and at least one connecting pin hole in said link plate in a single punching step, and in which said shaving die shaves said outer peripheral edges and an inner peripheral edge of said at least one connecting pin hole in a single shaving step.

6. A method of manufacturing a link plate for a roller chain, comprising the steps of:

intermittently forwarding a band of sheet steel along a path past a plurality of dies arranged in succession along the direction in which said band of sheet steel is forwarded, wherein at least one of said dies is a rough punching die, and at least one other one of said dies is a shaving die, said rough punching die and said shaving die being positioned symmetrically in relation to, and on opposite sides of, an intermediate position along said direction;

punching said band of steel sheet by said rough punching die, thereby punching out a portion of said band to form an edge of a link plate;

aligning said shaving die closely with said edge of a link plate formed by said rough punching die; and shaving said edge of said link plate by said shaving die; in which said rough punching die forms outer peripheral edges of a link plate and at least one connecting pin hole in said link plate in a single punching step, and in which said shaving die shaves said outer peripheral edges and an inner peripheral edge of said at least one connecting pin hole in a single shaving step.

* * * * *